US006491489B1

(12) United States Patent
Stragier

(10) Patent No.: US 6,491,489 B1
(45) Date of Patent: Dec. 10, 2002

(54) ROLLING PIVOT LOADING DEVICE

(75) Inventor: Marcel G. Stragier, Scottsdale, AZ (US)

(73) Assignee: The Hell Co., Chattanooga, TN (US)

( * ) Notice: Subject to any disclaimer, the term of this patent is extended or adjusted under 35 U.S.C. 154(b) by 36 days.

(21) Appl. No.: 09/792,715

(22) Filed: Feb. 23, 2001

(51) Int. Cl.[7] ..... B65F 3/08
(52) U.S. Cl. ..... 414/409
(58) Field of Search ..... 414/409

(56) References Cited

U.S. PATENT DOCUMENTS 3,087,637 A * 4/1963 Fox ..... 414/409

FOREIGN PATENT DOCUMENTS

GB 2168316 * 6/1986 ..... 414/409

* cited by examiner

*Primary Examiner*—Steven A. Bratlie
(74) *Attorney, Agent, or Firm*—Parson & Goltry; Robert A. Parsons; Michael W. Goltry

(57) ABSTRACT

A loading device including a guide frame, a drive mechanism and a lift mechanism. The guide frame includes a pair of spaced apart upright members each having a slot formed therethrough. The drive mechanism is coupled to the guide frame and has a shaft received concurrently through the slots of the guide frame, a sprocket mounted on the shaft, a belt member wrapped about the sprocket and having opposing ends anchored to the guide frame, and a motor coupled to the shaft for reciprocating the shaft vertically within the slots between an upper position and a lower position. Movement of the shaft toward the upper position produces rotation of the shaft in a first direction and a movement of the shaft toward the lower position rotates the shaft in an opposing direction. The lift mechanism is coupled to the drive mechanism and includes a pair of arms each having an end coupled to the shaft and another end coupled to a carriage.

44 Claims, 9 Drawing Sheets

ROLLING PIVOT LOADING DEVICE

FIELD OF THE INVENTION

This invention relates to refuse collection.

More particularly, the present invention relates to loading devices for use in refuse collection.

BACKGROUND OF THE INVENTION

The need to collect refuse is an ever present and growing demand. As populations continue to increase, the need for efficient and inexpensive refuse collection becomes more important. Automatic devices which grasp and dump refuse containers into a refuse collection vehicle are well known and have long been employed. However, many of these devices are expensive, unreliable or not sufficiently robust to handle large refuse receptacles.

Front loading devices are typically very robust for handling large refuse receptacles such as bins. These devices typically include a pair of parallel, forwardly extending forks that are received within slots in the bin. The bin is then lifted and emptied into the vehicle. The drawback to these types of loading devices is that the refuse vehicle must have enough space to directly face the bin. Additionally, the vehicle must back away from the receptacle after loading. This can significantly add to the cycle time of collecting refuse from each receptacle.

Side loaders have been developed to increase the speed and efficiency of refuse collection. Side loaders typically include an articulated arm that reaches out to grasp a refuse container. The container is then lifted and emptied over a hopper of the vehicle. While extremely effective and efficient, current side loaders are less robust than front loaders and are limited to engaging smaller refuse containers. An additional problem with conventional side loader is the requirement of lateral space. Many side loaders move the refuse container in an outward and upward arc. This can prevent the loader from collecting containers substantially up against an obstruction such as a wall, fence, building etc.

Generally stronger side loaders have been developed utilizing linkage arms to raise a larger container along a track adjacent the side of the vehicle. A single cylinder moving an arm can achieve a maximum rotation of 120 degrees. This is insufficient to lift and dump a container. Generally a rotation of approximately 240 degrees is required. This has been achieved by using multiple pivots and multiple links for each arm. While marginally successful, the large number of pivots and links results in a complex, expensive and unreliable device. Each pivot point is a point of wear which greatly reduces the lifetime of the device and increases maintenance and operating costs.

It would be highly advantageous, therefore, to remedy the foregoing and other deficiencies inherent in the prior art.

Accordingly, it is an object of the present invention to provide a new and improved loading device.

Another object of the invention is to provide a side loading device which will handle large capacity refuse containers.

And another object of the invention is to provide a loading device which is very efficient.

Still another object of the present invention is to provide a loading device that will lift a refuse container along a path parallel to the side of the body of a refuse vehicle.

Yet another object of the invention is to provide a loading device which is robust.

SUMMARY OF THE INVENTION

Briefly, to achieve the desired objects of the instant invention in accordance with a preferred embodiment thereof, provided is a loading device including a guide frame, a drive mechanism, and a lift mechanism. The guide frame includes a first upright member having an upper end and a lower end and a slot formed therethrough and a second upright member having an upper end and a lower end and a slot formed therethrough. The second upright member is coupled in spaced apart parallel relation to the first upright member with the slot of the first upright member substantially aligned with the slot of the second upright member. The drive mechanism is coupled to the guide frame and includes a shaft received concurrently through the slot of the first upright member and the slot of the second upright member. A sprocket is mounted on the shaft and a belt member is wrapped about the sprocket. The belt member has opposing ends anchored to the guide frame. A motor is coupled to the shaft for reciprocating the shaft vertically within the slots between an upper position and a lower position, movement of the shaft toward the upper position producing rotation of the shaft in a first direction and a movement of the shaft toward the lower position rotating the shaft in an opposing direction. The lift mechanism is coupled to the drive mechanism and includes a first arm having a first end coupled to the shaft and a second end, a second arm having a first end coupled to the shaft and a second end, and a carriage coupled to the second ends of the first arm and the second arm.

In a further aspect of the invention the belt member includes a first belt portion and a second belt portion. The first belt portion has a first end coupled to an outer periphery of the sprocket and a second end coupled to an upper portion of the guide frame. The second belt portion has a first end coupled to an outer periphery of the sprocket and a second end coupled to a lower portion of the guide frame.

In yet another aspect of the invention, the drive mechanism further includes a second sprocket mounted on the shaft spaced from the sprocket, a second belt member wrapped about the second sprocket with opposing ends anchored to the guide frame, and a second motor coupled to the shaft for reciprocating the shaft vertically within the slots between an upper position and a lower position in concert with the motor.

In additional aspects of the present invention, the loading device includes an extension mechanism and an engagement mechanism.

BRIEF DESCRIPTION OF THE DRAWINGS

The foregoing and further and more specific objects and advantages of the instant invention will become readily apparent to those skilled in the art from the following detailed description of preferred embodiments thereof taken in conjunction with the drawings, in which.

DETAILED DESCRIPTION OF PREFERRED EMBODIMENTS

Figure 1:
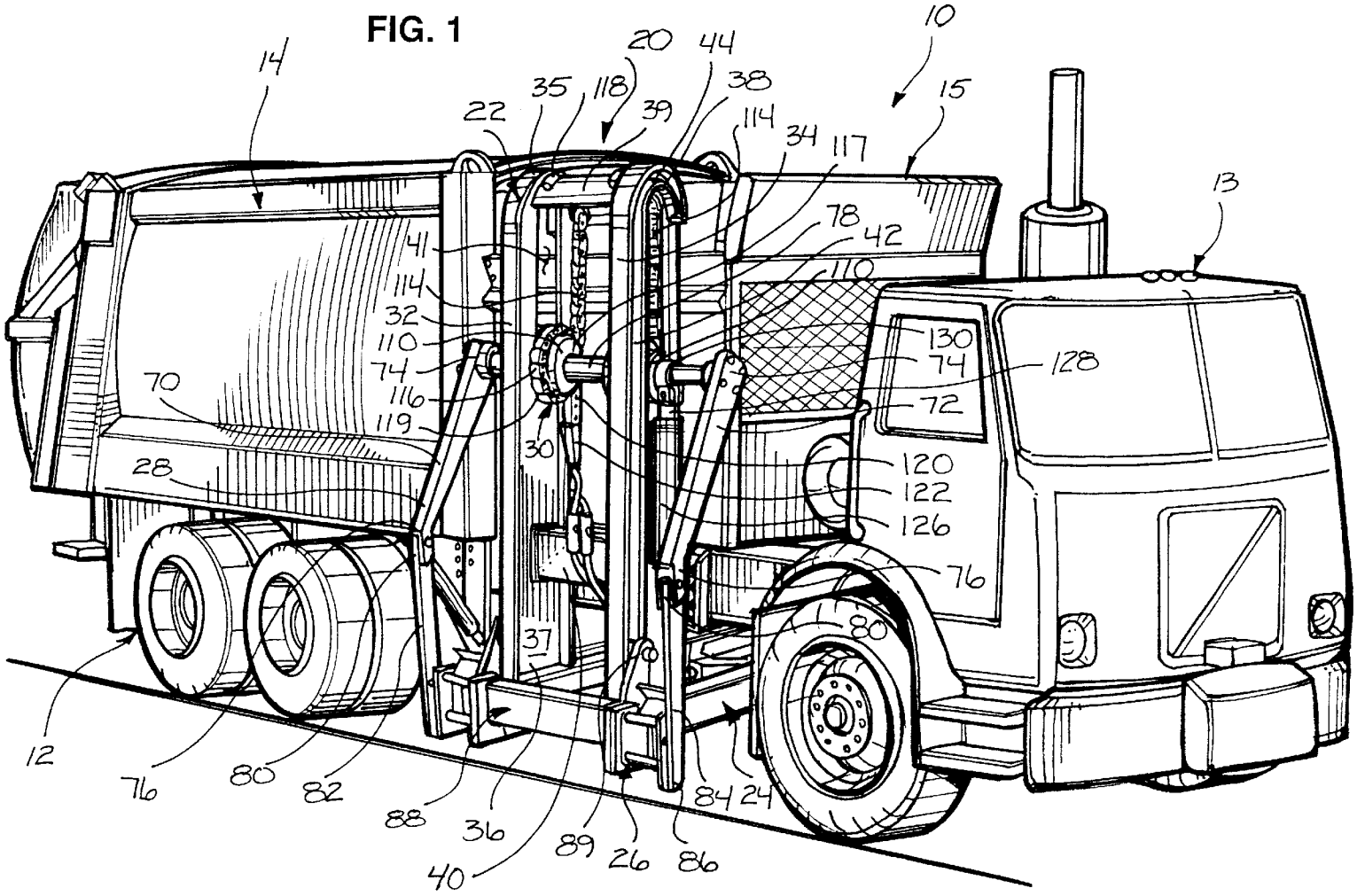
FIG. 1 is a perspective view illustrating a refuse collection vehicle and loading device according to the present invention.

Turning now to the drawings in which like reference characters indicate corresponding elements throughout the several views, attention is first directed to FIG. 1 which illustrates a refuse collection vehicle generally designated 10, incorporating a loading mechanism generally designated 20, according to the present invention. Refuse collection vehicle 10 includes a chassis 12 carrying a cab 13 at one end and a refuse collection body 14 at the other end. A hopper/compactor 15 is carried between cab 13 and body 14 for receipt of refuse. Hopper/compactor 15 is slightly less wide than body 14, providing an inset portion sufficient to accommodate loading mechanism 20 in a stowed or retracted configuration. It will be understood that various other vehicle configurations, such as an open body without a compactor or hopper, can be employed in combination with loading mechanism 20. However, for purposes of this description, the above-illustrated vehicle will be employed throughout the drawings and description.

Figures 2, 3:
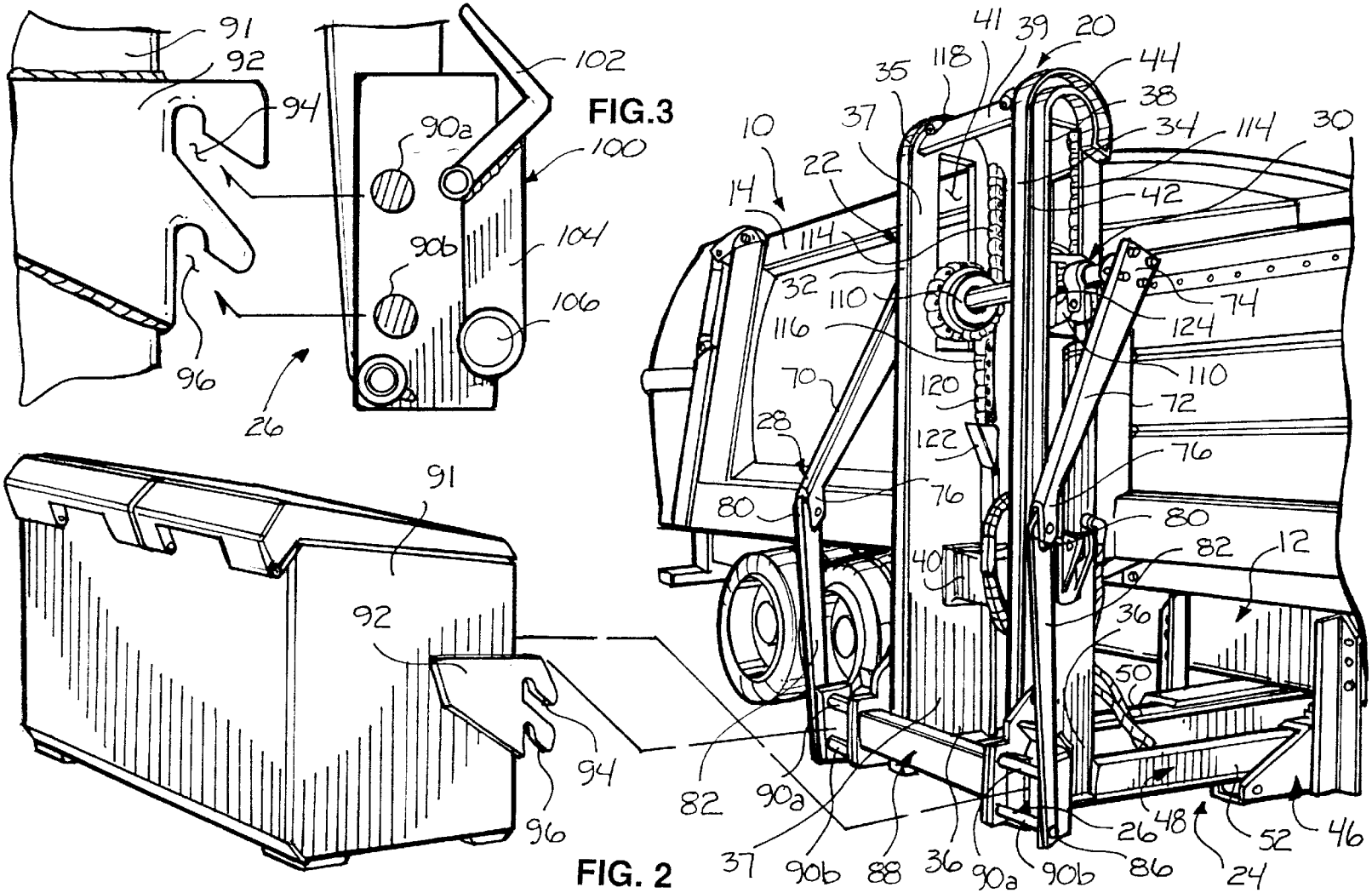
FIG. 2 is a perspective view of the loading device and partial view of the refuse vehicle of FIG. 1, prior to engaging a refuse bin.
FIG. 3 is an enlarged fragmentary view of the loading device showing an engagement mechanism.

With additional reference to FIG. 2, Loading mechanism 20 includes a guide frame 22, an extension mechanism 24, an engagement mechanism 26, a lift mechanism 28 and a drive mechanism 30. Guide frame 22 includes a pair of upright members 32 and 34 spaced apart, in this embodiment, along a longitudinal axis of vehicle 10. Upright members 32 and 34 each include an upper end 35, a lower end 36, an inner surface 37 and an outer surface 38. Upright members 32 and 34 are rigidly maintained in a spaced apart parallel relationship with inner surfaces 37 directed toward one another by an anchor member 39 extending between the upper ends 35 of upright members 32 and 34, and a cross brace 40 extending between upright members 32 and 34 intermediate upper ends 35 and lower ends 36. A drive mechanism guide is carried by guide frame 22. In this embodiment, the drive mechanism guide includes a slot 41 formed centrally through an upper portion of each upright member, from a generally central location extending to a point proximate upper ends 35, and from inner surface 37 to outer surface 38, for purposes which will be described presently. A guide slot or track 42 is formed on outer surface 38 of each upright member 32 and 34, extending from lower ends 36 and terminating in a curved portion 44 proximate upper ends 35 and curving over slots 41.

Still referring to FIGS. 1 and 2, guide frame 22 is mounted to vehicle 10 by extension mechanism 24. Extension mechanism 24 includes an inner frame 46 mounted to chassis 12 of vehicle 10, and an outer frame 48 telescopingly received by inner frame 46. Outer frame 48 is movable between a retracted position (toward vehicle 10) and an extended position (away from vehicle 10).

Figure 4:
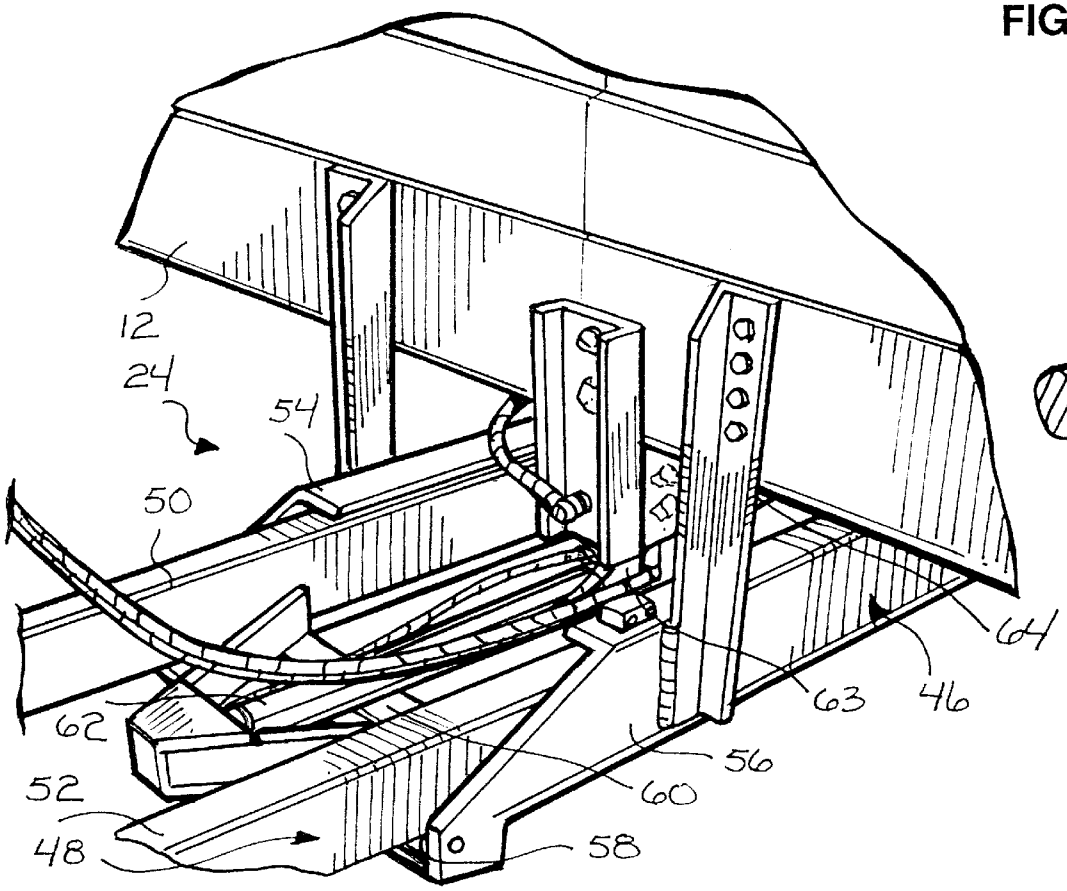
FIG. 4 is an enlarged fragmentary view of the loading device showing an extension mechanism.

As can be seen with additional reference to FIG. 4, outer frame 48 includes a pair of slide members 50 and 52, coupled to and maintained in a parallel spaced apart relationship by lower ends 36 of upright members 32 and 34 respectively. Slide members 50 and 52 extend inwardly (toward vehicle 10) and are slidably received within a pair of track members 54 and 56 of inner frame 46. Track members 54 and 56 are preferably channels to securely retain slide members 50 and 52, although it will be understood that they can be tubular or include brackets, etc. To facilitate relative movement of slide members 50 and 52, rollers 58 are positioned on an inner bottom surface of each track member 54 and 56 upon which slide members 50 and 52 ride. Track members 54 and 56 are maintained in a parallel spaced apart relationship by a cross piece 60 mounted beneath and between outer ends thereof.

To actuate movement of outer frame 48, a motor, such as a hydraulic cylinder 62, is mounted to cross piece 60. While the present embodiment incorporates hydraulic cylinders throughout, it will be understood that other motors, such as pneumatic cylinders, electric motors, etc., may be employed. Cylinder 62 includes a rod 63 coupled to a cross piece 64 of outer frame 48 extending between slide members 50 and 52 proximate an end toward vehicle 10. In other words, cross piece 64 is inward of cross piece 60. Thus, upon extension of hydraulic cylinder 62 outer frame 48 is moved to the retracted position, and upon retraction of hydraulic cylinder 62 outer frame 48 is moved to the extended position. This configuration enables loading device to be mounted under chassis 12, and extension mechanism 24 to be substantially carried under vehicle 10 in the retracted position. By mounting loading device under chassis 12, the length of vehicle 10 can be shorter as there is no need to accommodate the loader between cab 13 and hopper 15.

Referring back to FIGS. 1 and 2, guide frame 22 carries a lift mechanism 28. Lift mechanism 28 includes a pair of arms 70 and 72 each having an end 74 and an opposing end 76. A shaft 78 is coupled between ends 74 of arms 70 and 72 and passes through slots 41 of upright members 32 and 34. Shaft 78 is supported within slots 41 by drive mechanism 30. Rotation of shaft 78 and linear reciprocation of shaft 78 along slots 41 by drive mechanism 30, rotates and lifts arms 70 and 72 which are positioned adjacent outer surfaces 38 of upright members 32 and 34, respectively. Ends 76 of arms 70 and 72 are pivotally coupled to ends 80 of links 82 and 84, respectively. The opposing ends 86 of links 82 and 84 are pivotally coupled to a carriage 88. Carriage 88 includes cam followers 89 mounted at each end thereof and directed inwardly. Cam followers 89 are received within tracks 42 and are free to move upwardly and downwardly therein. Thus, carriage 88 is reciprocally movable along track 42 by lift arms 70 and 72, and links 82 and 84.

Turning now to FIG. 2, with additional reference to FIG. 3, engagement mechanism 26 is coupled to carriage 88 and configured to engage a refuse bin 91. Engagement mechanism 26 includes two pairs of horizontal pins 90*a* and 90*b*, each pair on opposing ends of carriage 88 positioned substantially between upright members 32 and 34 and links 82 and 84, respectively. Pins 90*a* and 90*b* of each pair are spaced apart vertically and rigidly coupled to carriage 88. A hook bracket 92 is coupled to opposing side of refuse bin 91 extending forwardly away from the bin, past the front thereof. Each hook bracket 92 includes a pair of notches 94 and 96 corresponding to pins 90*a* and 90*b*. Upon moving guide frame 22 outward by moving outer frame 48 of extension mechanism 24 to the extended position, carriage 88 is positioned with the pairs of pins 90*a* and 90*b* aligned with the mouths of notches 94 and 96 in hook bracket 92. As carriage 88 is lifted by lift mechanism 28, pins 90*a* and 90*b* are received within corresponding notches 94 and 96, and firmly seated against the base thereof.

Figures 6, 7:
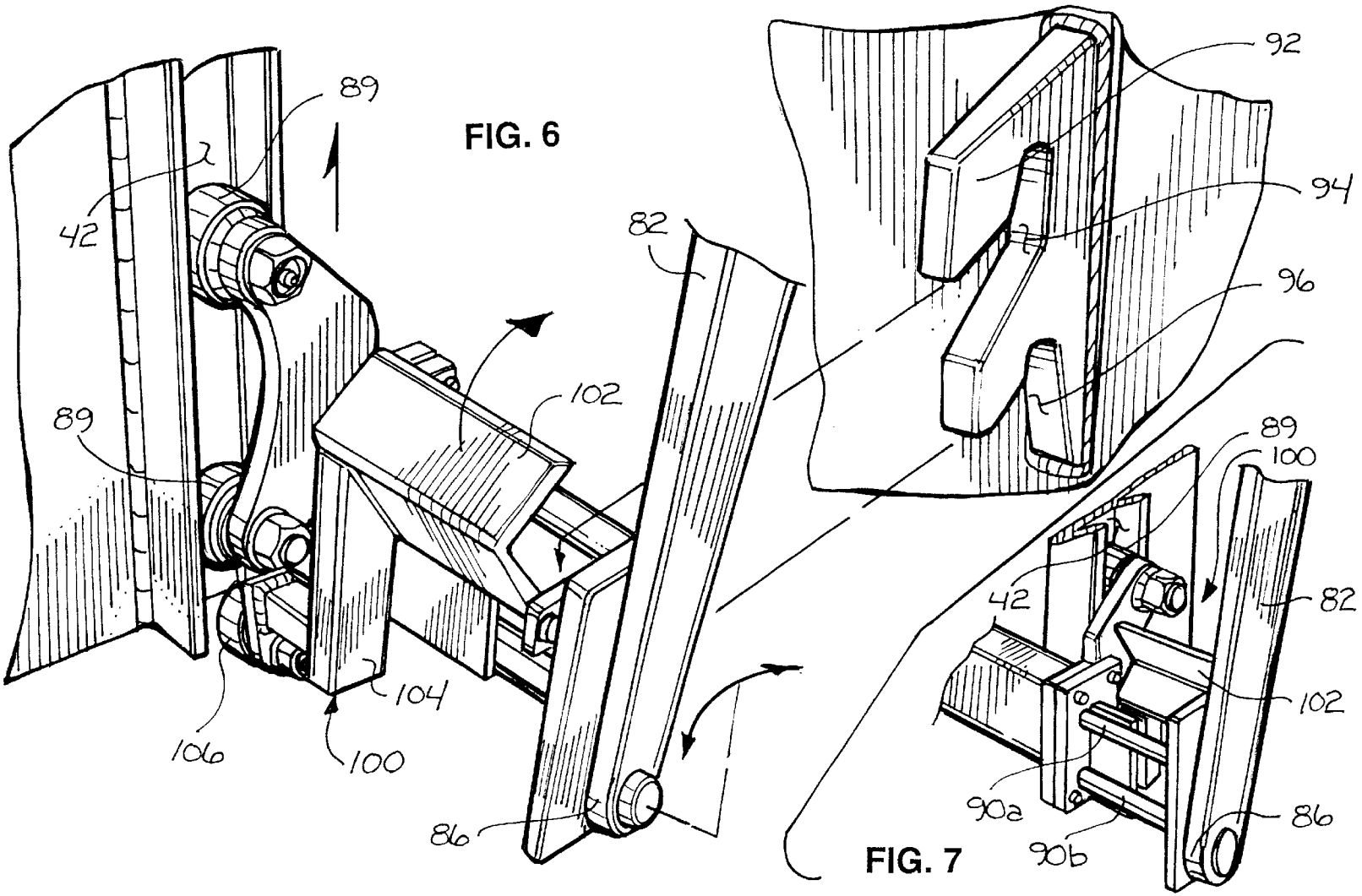
FIG. 6 is an enlarged fragmentary view illustrating the locking mechanism of the engagement mechanism.
FIG. 7 is a fragmentary view of the engagement mechanism.

As the lifting cycle continues, as will be described presently, a locking mechanism 100 is engaged to retain pins 90*a* and 90*b* within notches 94 and 96. With reference to FIGS. 6 and 7, lock mechanism 100 includes an L-shaped lock member 102 pivotally mounted to carriage 88 above each set of pins 90*a* and 90*b*. An actuating extension 104 extends from lock member 102, terminating in a cam follower 106. Cam follower 106 rides within tracks 42, following cam followers 89. Lock member 102 is normally in the unlocked position, as shown in FIGS. 6 and 7, but is moved to the locked position relative pins 90*a* and 90*b* upon entry of cam followers into curved portion 44 of track 42. As cam followers 48 move around curved portion 44 and cams 106 are still in the straight portion of track 42, lock member 102 moves relative pins 90*a* and 90*b* to a position overlying pins 90*a* and 90*b*. Thus, when bin 91 is engaged by engagement mechanism 26, locking member 102 overlies the top of hook bracket 92 securely locking hook bracket between lock member 102 and pins 90*a* and 90*b* at the top of the discharge cycle.

Figure 5:
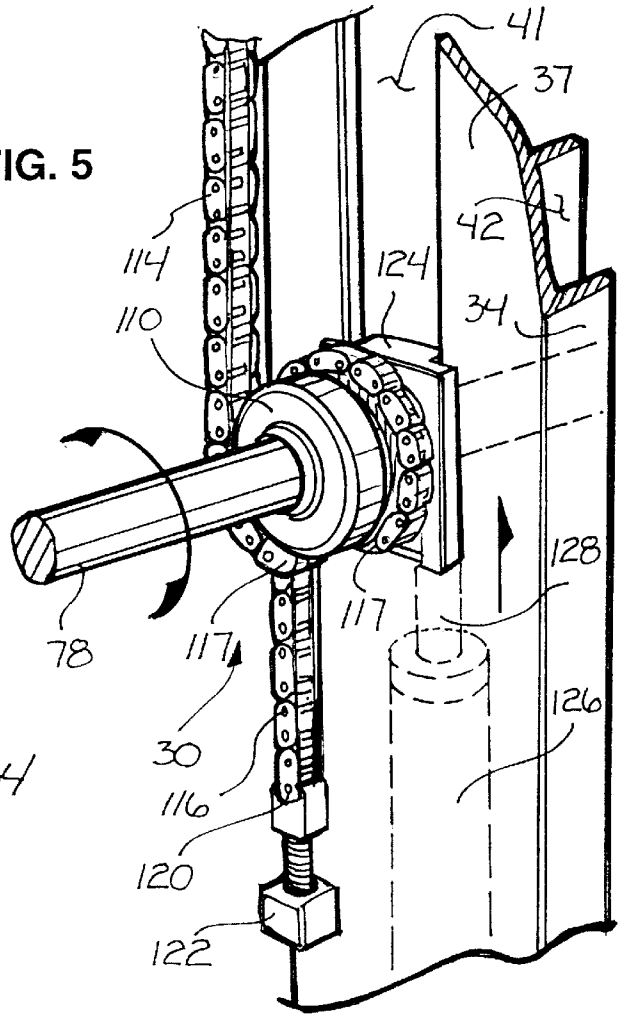
FIG. 5 is an enlarged fragmentary view of the loading device showing a portion of a drive mechanism.

Turning back to FIGS. 1 and 2 and with additional reference to FIG. 5, drive mechanism 30 includes a pair of sprockets 110 each mounted on shaft 78 between upright members 32 and 34. A belt member consisting of pair of belts portions 114 and 116 is associated with each of sprockets 110. In this embodiment, each sprocket 110 includes a pair of belt receiving portions. As will be described presently, a single belt portion can be used in some situations. When a single belt portion is employed, the sprocket will have a single belt receiving portion. Belts portions 114 and 116 each have an end 117 and 119, respectively, each coupled to an outer periphery of their associated sprocket 110 and an opposing end 118 and 120, respectively. Upper ends 118 of belt portions 114 are fixed to anchor member 39 and lower ends 120 are fixed to anchors 122 coupled to inner surfaces 37 of upright members 32 and 34 below slots 41. As shaft 78 is lifted, belt portions 116 unwrap from the belt receiving portion sprockets 110, causing rotation of shaft 78, and belt portions 114 are wrapped about other belt receiving portions of sprockets 110. The reverse occurs on the downward movement of shaft 78. Belt portions 114 and 116 can be substantially any flexible material such as cable, rope, reinforced rubber materials, etc. but in the preferred embodiment are chain to reduce stretching and have high strength. Sprockets 110 can be toothed (or frictionally engage the belt) or smooth. If the sprocket is toothed the belt member may be a single belt portion anchored at both ends and wrapped about sprockets 110. In this instance, sprockets 110 have a single belt receiving portion. A generally smooth sprocket has a belt receiving portion for each belt portion 114 and 116 with the ends of belt portions 114 and 116 fixed to the outer circumference thereof. Additionally, sprockets 110 can be eccentric to shaft 78 to provide an advantage if desired, by changing the speed or the lift capacity as shaft 78 is lifted or lowered.

Each end of shaft 78 is journaled in a yoke block 124 supporting shaft 78 within slots 41. Each yoke block 124 rides within slot 41, stabilizing and guiding shaft 78 in a vertically reciprocating movement along slot 41. It should be noted that while the drive mechanism guide includes slots 41 in this embodiment, other options are possible. For example, each yoke block can be slidably engaged with a each upright member 32 and 34 such as by a flange at the edge thereof. The use of slot 41 has been found to be the easiest and most effective drive mechanism guide. A hydraulic cylinder 126 is coupled to outer surface 38 of each upright member, and includes a rod 128 terminating in a bearing coupling 130. Each bearing coupling 130 is coupled to shaft 78 outside of yoke block 124. Bearing couplings 130 enable cylinders 126 to move shaft 78 upward along slots 41 during extension and downward during retraction of rod 128, while allowing rotation of shaft 78. A pair each, of sprockets, belt portions and cylinders are employed to provide a uniform, stable and strong drive mechanism for rotating and lifting large and heavy refuse receptacles.

In operation, cylinders 126 drive shaft 78 upward. As shaft 78 moves upward in slot 41, fixed belt portions 114 and 116 cause it to rotate. The upward movement and rotation of shaft 78 translates to upward movement and rotation of lift mechanism 28. Movement of shaft 78 within slot 41 greatly reduces the length required of arms 70 and 72. This reduction in length corresponds to a reduction in the power needed to be delivered by cylinders 126. By employing a reduced size cylinder 126, much less hydraulic fluid is required greatly reducing cost and maintenance problems.

Figure 8B:
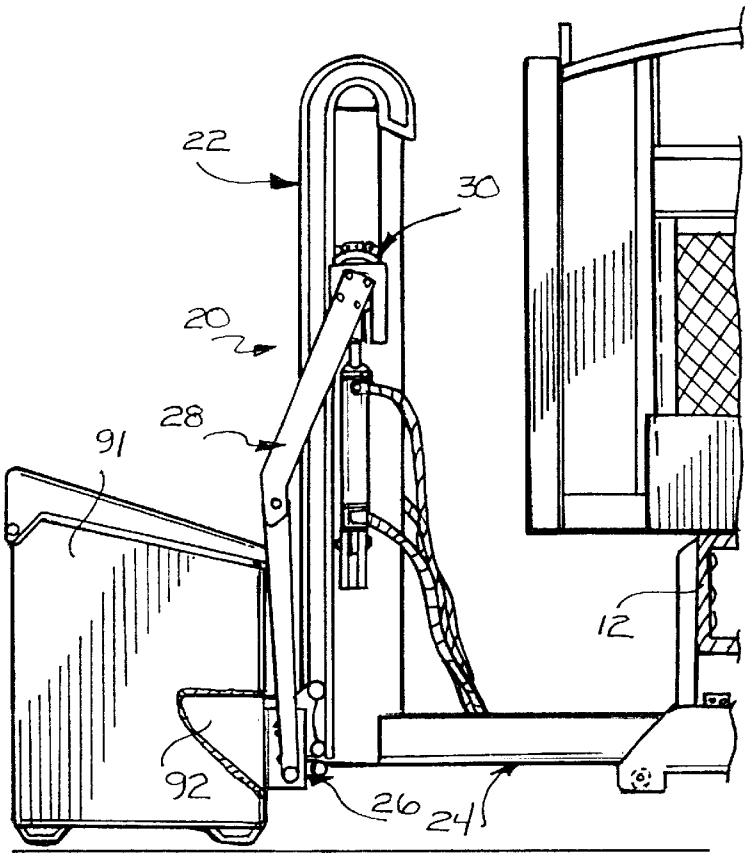
FIGS. 8*a–d* illustrate the loader mechanism progressing through a discharge cycle.
Figure 8A:
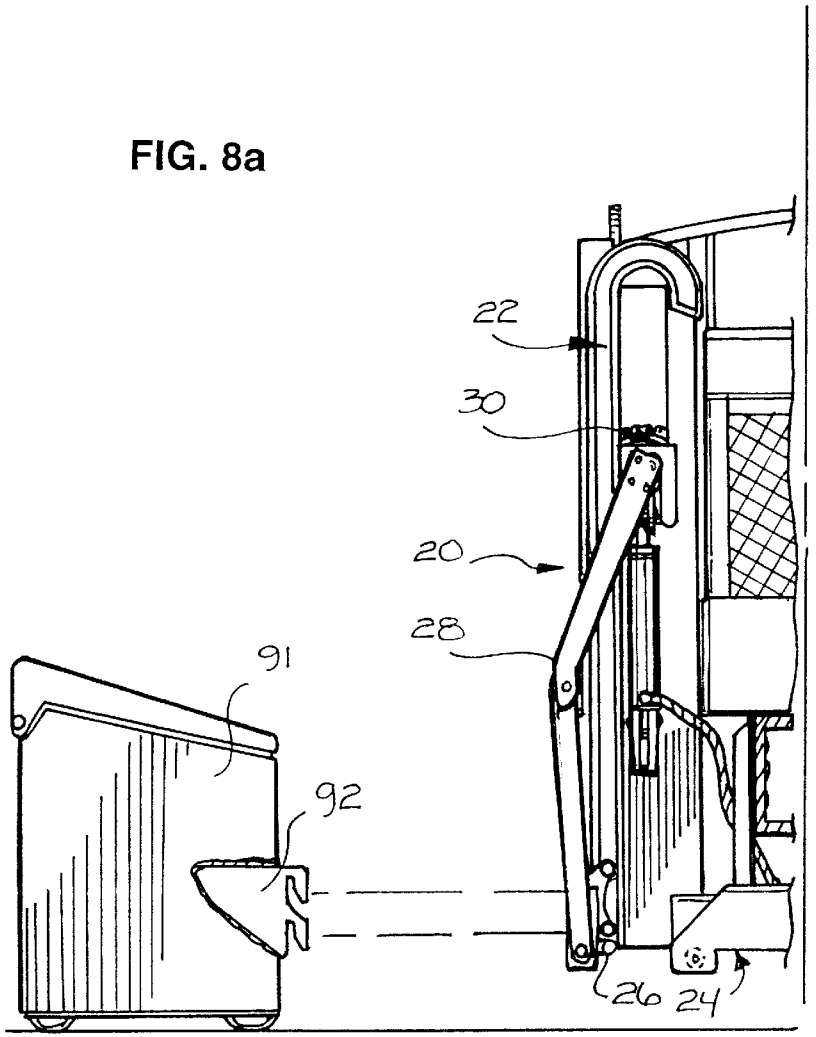
Figure 8D:
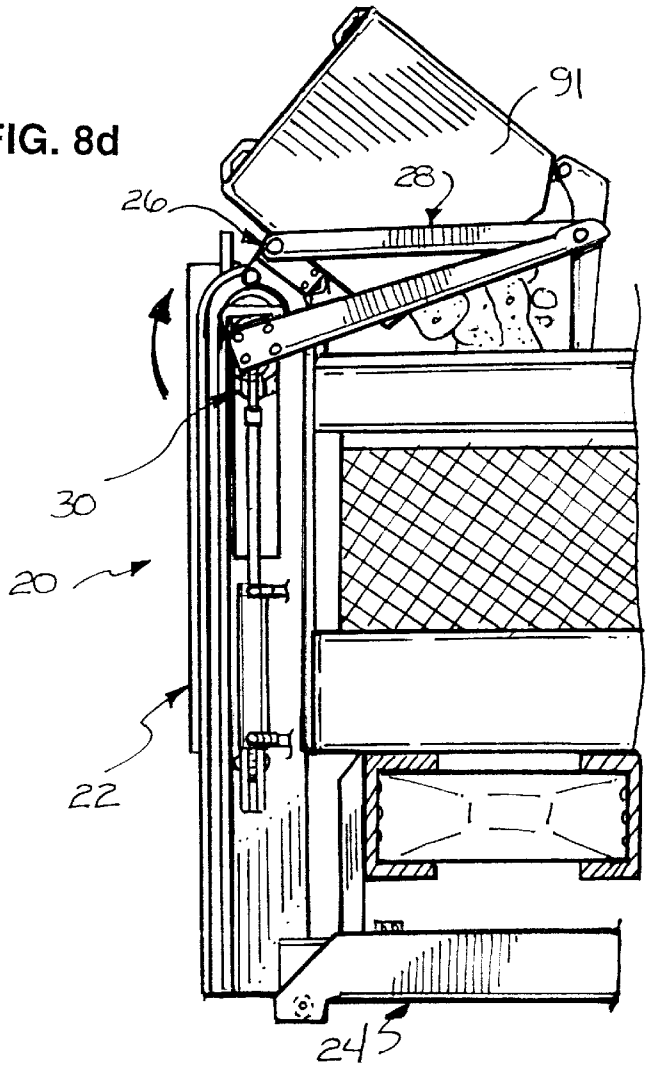
Figure 8C:
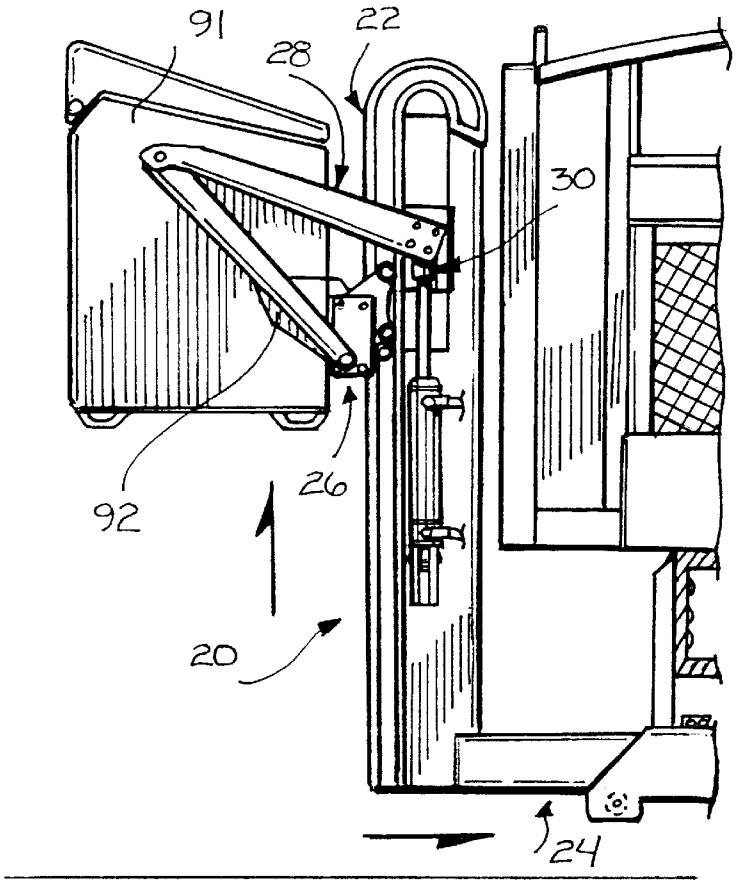

Turning now to FIGS. 8*a–d*, the operation of loading device 20 is illustrated. Referring specifically to FIG. 8*a*, loading device 20 is positioned adjacent refuse bin 91. Extension mechanism 24 is actuated moving guide frame 22, lift mechanism 28 and engagement mechanism 26 toward bin 91. At the appropriate extension distance, engagement mechanism 26 is positioned at hook bracket 92 as shown in FIG. 8*b*. Discharge of bin 91 is then accomplished by actuating drive mechanism 30. Turning to FIG. 8*c*, extension mechanism 24 is retracted, drawing guide frame 22 and refuse bin 91 to the retracted position adjacent refuse vehicle 10. Cylinders 126 are then extended, raising and rotating shaft 78. A corresponding lifting and rotation of lift mechanism 28 occurs. Carriage 88 maintains a linear and vertical lift along tracks 42 guided by cam followers 89. The pivotal coupling between arms 70 and 72, links 82 and 84, and carriage 88, permit this movement. At the top of the cycle, cam followers 89 enter curved portion 44 of track 42 and tip carriage 88 and bin 91 into a discharge angle as shown in FIG. 8*d*. In this embodiment, carriage 88 is pivoted through approximately 135 degrees. Bin 91 is held to carriage 88 by the action of locking mechanism 100 as described previously. Lock member 102 covers the top of hook bracket 92 in a relative movement between it and pins 90*a* and 90*b* as cam followers 89 enter curved portion 44 and cam follower 106 trails behind the curve. Retraction of cylinders 126 reverses the steps.

Thus, linear movement is converted into a combination of linear and rotation movement using a minimum of links and moving parts to achieve a rotation of lift mechanism 28 of approximately 240 degrees. Furthermore, by maintaining carriage 88 in a linear vertical path, need for lateral clearance is greatly reduced. In other words, since the bin is not moved in an outward and upward arc, loader device 20 can be used substantially up against an obstruction such as a wall, fence, building etc.

Figure 9:
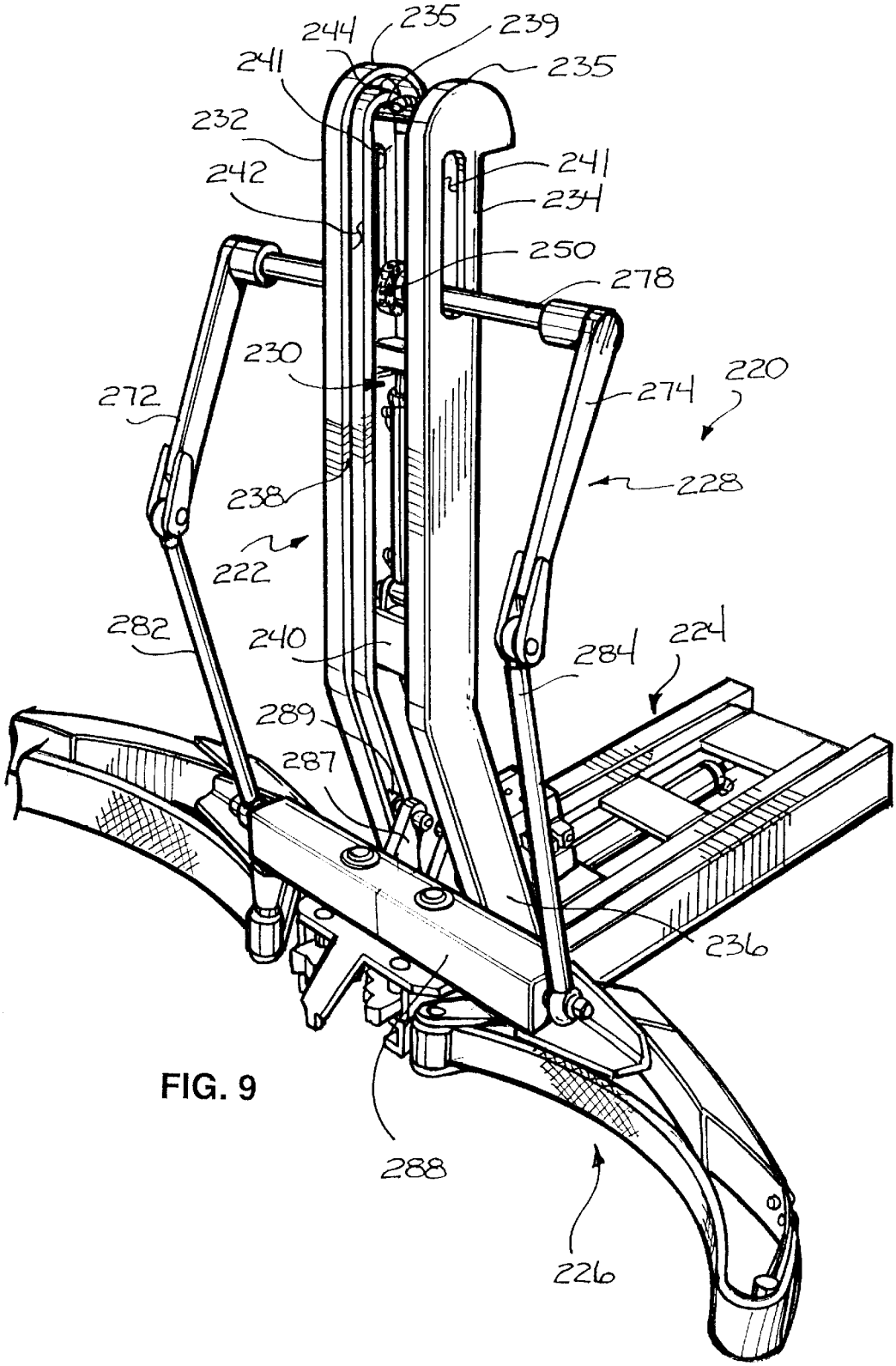
FIG. 9 is a perspective view illustrating another embodiment of a loading device according to the present invention.
Figure 10:
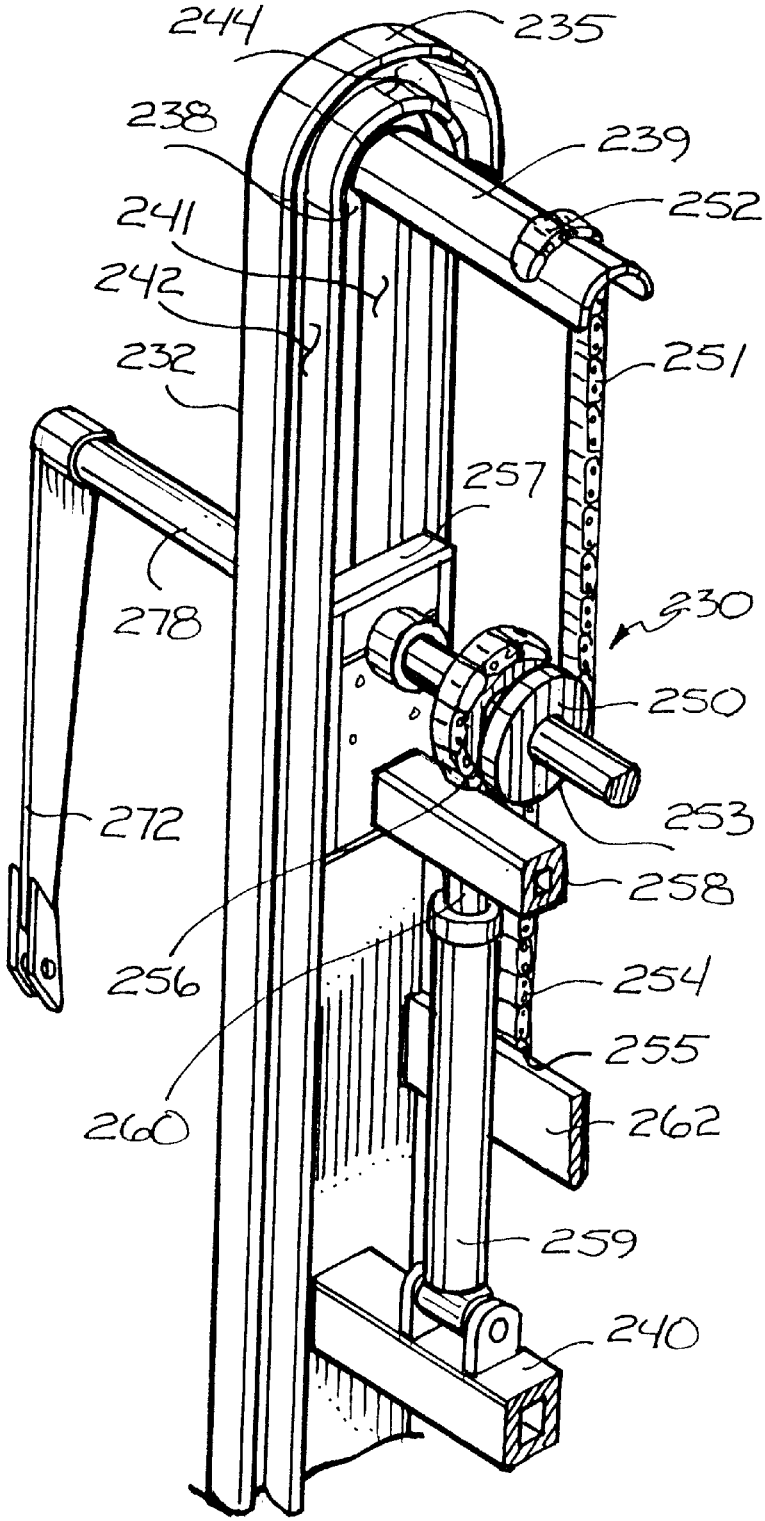
FIG. 10 is a partial perspective view of the loading mechanism of FIG. 9 illustrating the drive mechanism.

With attention directed to FIGS. 9 and 10, another embodiment of a loading device, generally designated 220, is illustrated. Loading mechanism 220 includes a guide frame 222, an extension mechanism 224, an engagement mechanism 226, a lift mechanism 228 and a drive mechanism 230. Guide frame 222 is substantially similar to guide frame 22, and includes a pair of spaced apart upright members 232 and 234 each having an upper end 235 and a lower end 236. Upright members 232 and 234 are rigidly maintained in a parallel spaced relationship by an anchor member 239 and a cross brace 240. Anchor member 239 extends between upper ends 235, and cross brace 240 extends between upright members 232 and 234 intermediate upper ends 235 and lower ends 236. A slot 241 is formed centrally through an upper portion of each upright member to act as the drive mechanism guide. A guide track 242 is formed on an inner surface 238 of each upright member 232 and 234. Tracks 242 extend from lower ends 236 and terminating in a curved portion 244 proximate upper ends 235.

Lift mechanism 228 is substantially identical to lift mechanism 28, including arms 272 and 274 attached to a shaft 278 extending through slots 241, and links 282 and 284 terminating in a carriage 288 guided by cam followers 289 directed outwardly from centrally positioned brackets 287. Outwardly extending cam followers 289 ride within tracks 242. Engagement mechanism 226, in this embodiment, is a conventional gripping device as are well known in the art. The gripping device will not be described in detail, as it is well known. Extension mechanism 224 is substantially identical to extension mechanism 24, and therefore will not be described further.

Still referring to FIG. 9, with particular reference to FIG. 10, drive mechanism 230 is similar to drive mechanism 30, differing in that a single sprocket having a pair of belt receiving portions, a single belt member including a set of belt portions, and cylinder is employed. Sprocket 250 is mounted centrally on shaft 278 between upright members 232 and 234. A belt portion 251 having opposing ends 252 and 253 is coupled sprocket 250. Upper end 252 of belt portion 251 is fixed to anchor member 239 and lower end 253 is fixed to an outer periphery of sprocket 250. A belt portion 254 having opposing ends 255 and 256 is coupled to sprocket 250. Lower end 255 of belt 254 is fixed to an anchor 262 coupled to inner surfaces 238 of upright members 232 and 234 below slots 241 and upper end 256 is fixed to an outer periphery of sprocket 250. Each end of shaft 278 is journaled in a sliding yoke block 257 supporting shaft 278 within slots 241. Each yoke block 257 rides within slot 241, stabilizing and guiding shaft 278 in a vertically reciprocating movement along slot 241. Yoke blocks 257 are coupled by a member 258 beneath shaft 278. A single hydraulic cylinder 259 is coupled to cross brace 240, and includes a rod 260 coupled to member 258. In this arrangement, cylinder 259 can move shaft 278 upward along slots 241 by moving yoke blocks 257 upward during extension and downward during retraction of rod 260, while allowing rotation of shaft 278. This embodiment is intended to be employed in lifting smaller refuse receptacles, and is therefore of a less robust nature.

Figure 11:
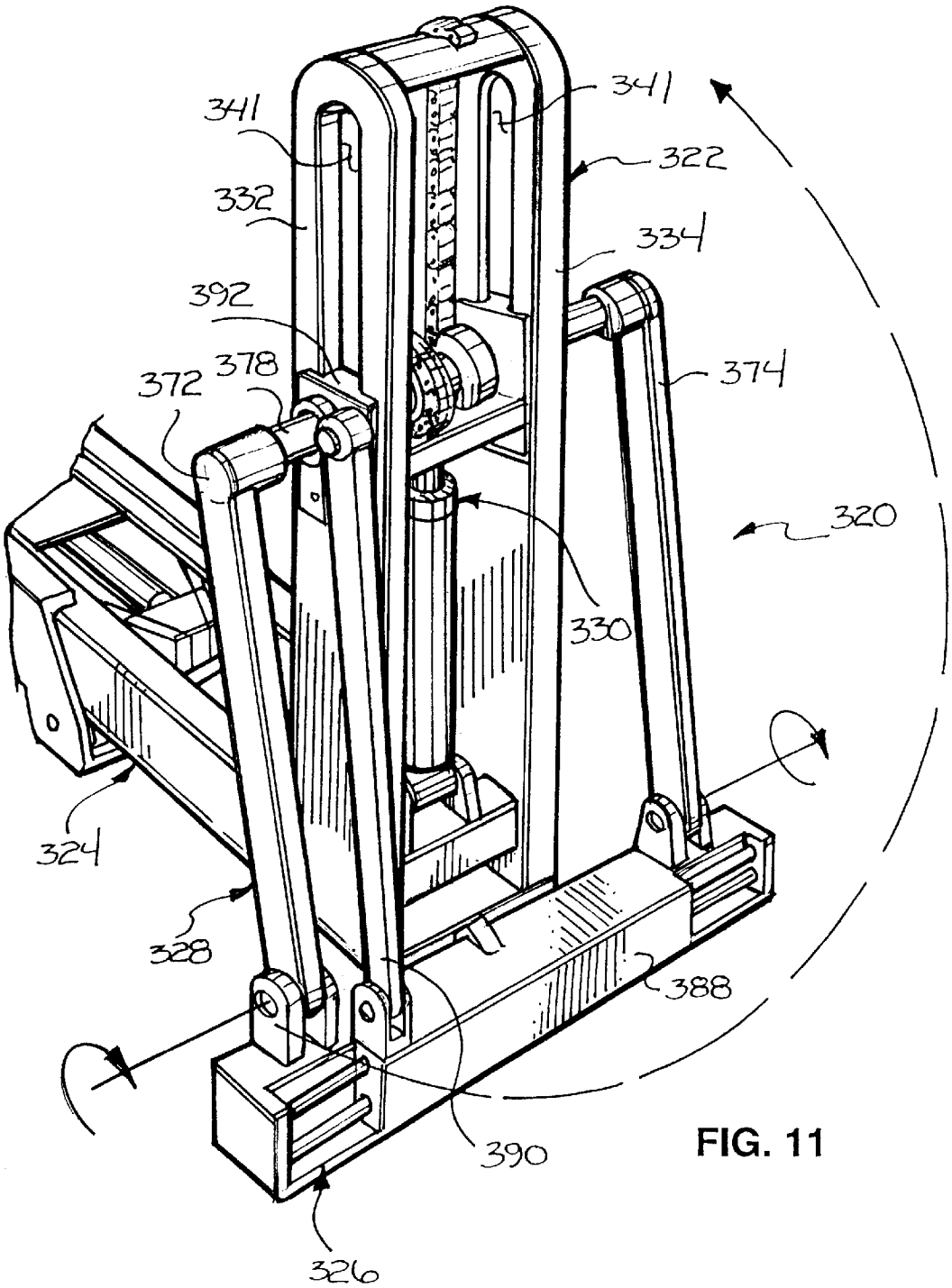
FIG. 11 is a perspective view illustrating yet another embodiment of a loading device according to the present invention.

Referring now to FIG. 11, another embodiment of a loading device, generally designated 320 is illustrated. Loading mechanism 320 includes a guide frame 322, an extension mechanism 324, an engagement mechanism 326, a lift mechanism 328 and a drive mechanism 330, as did the previous embodiments. Loading device 320 is shown to illustrate a number of modifications that can be made to the previous embodiments. Specifically, while drive mechanism 326 and extension mechanism 324 are each generally similar to those described in previous embodiments, guide frame 322 lacks the tracks located on inner or outer surfaces of upright members 332 and 334. Furthermore, lift mechanism 328 includes arms 372 and 374 attached to a shaft 378 extending through slots 341 formed in upright members 332 and 334 and terminating in a pivotal engagement with a carriage 388. As will be noted, additional links are not coupled to arms 372 and 374. Since no tracks are present in upright members 332 and 334, carriage 388 is not coupled to guide frame 322 other than by arms 372 and 374. A guide link 390 extends between shaft 378 on one side of guide frame 322 and carriage 388 at a point proximate the end of arm 372 to provide lateral stability. Guide link 390 is coupled to shaft 378 by a yoke block 392 employed in drive mechanism 330 as previously described for the other embodiment. In this embodiment, carriage 388 is moved in an upwardly moving outwardly swinging arc. Guide link 390 guides carriage 388 to keep it relatively level at the beginning of the swinging arc and to force it to rotate into a discharge position at the upward end of the approximately 180 degree arc.

Various changes and modifications to the embodiments herein chosen for purposes of illustration will readily occur to those skilled in the art. For example, while the loading device is described for use in emptying refuse receptacles into a refuse vehicle, other uses are possible. By placing the guide frame in a horizontal position so that the shaft reciprocates horizontally the loading device can be employed as a compactor device, loading refuse into a collection body. As used here, the term loading refers to movement of some article or material and the lifting mechanism provides the lifting or motive force. In this instance, a refuse receptacle is replaced with a platen to move material. The platen can be moved in reciprocating directions. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

1. A loading device comprising:

a guide frame including:

a first upright member having an upper end and a lower end;

a second upright member having an upper end and a lower end, the second upright member coupled in spaced apart parallel relation to the first upright member; and a drive mechanism guide defined by the first upright member and the second upright member;

a drive mechanism coupled to the guide frame including:

a shaft received by drive mechanism guide;

a sprocket mounted on the shaft;

a belt member wrapped about the sprocket and having opposing ends anchored to the guide frame; and a motor coupled to the shaft for reciprocating the shaft vertically between an upper position and a lower position, movement of the shaft toward the upper position producing rotation of the shaft in a first direction and a movement of the shaft toward the lower position rotating the shaft in an opposing direction; and a lift mechanism coupled to the drive mechanism and including:

a first arm having a first end coupled to the shaft and a second end;

a second arm having a first end coupled to the shaft; and a second end; and a carriage coupled to the second ends of the first arm and the second arm.

2. A loading device as claimed in claim 1 wherein the belt member includes a first belt portion and a second belt portion, the first belt portion having a first end coupled to an outer periphery of the sprocket and a second end coupled to an upper portion of the guide frame, the second belt portion have a first end coupled to an outer periphery of the sprocket and a second end coupled to a lower portion of the guide frame.

3. A loading mechanism as claimed in claim 1 wherein the drive mechanism further includes a first yoke block slidably carried by the drive mechanism guide, and a second yoke block slidably carried by the drive mechanism guide, the shaft journaled concurrently therethrough.

4. A loading mechanism as claimed in claim 3 wherein the drive mechanism guide includes:

a first slot formed through the first upright member and slidably carrying the first yoke block; and a second slot formed through the second upright member and slidably carrying the second yoke block, the first slot substantially aligned with the second slot.

5. A loading mechanism as claimed in claim 3 wherein the motor includes a hydraulic cylinder mounted to the guide frame and having a rod terminating in a bearing coupling coupled to the shaft and permitting rotation thereof, extension of the hydraulic cylinder moving the shaft to the upper position and retraction of the hydraulic cylinder moving the shaft to the lower position.

6. A loading mechanism as claimed in claim 3 wherein the motor includes a hydraulic cylinder mounted to the guide frame and having a shaft coupled to the first yoke block and the second yoke block, extension of the hydraulic cylinder moving the shaft to the upper position and retraction of the hydraulic cylinder moving the shaft to the lower position.

7. A loading mechanism as claimed in claim 1 wherein the drive mechanism further includes:

a second sprocket mounted on the shaft spaced from the sprocket;

a second belt member wrapped about the second sprocket and having opposing ends anchored to the guide frame; and a second motor coupled to the shaft for reciprocating the shaft vertically between an upper position and a lower position in concert with the motor.

8. A loading mechanism as claimed in claim 1 wherein the guide frame further includes:

a first track formed in the first upright member and extending substantially from the lower end to terminate in a curved portion proximate the upper end for retaining and guiding the carriage; and a second track formed in the second upright member and extending substantially from the lower end to terminate in a curved portion proximate the upper end for retaining and guiding the carriage.

9. A loading mechanism as claimed in claim 7 wherein the carriage further includes cam follower carried on opposing ends thereof and receivable within and movable along the first track and the second track.

10. A loading mechanism as claimed in claim 8 wherein the lift mechanism further includes a first link pivotally coupled between the second end of the first arm and the carriage, and a second link pivotally coupled between the second end of the second arm and the carriage.

11. A loading device as claimed in claim 1 further including an extension mechanism for coupling the guide frame to a vehicle and moving the guide frame between an extended and a retracted position.

12. A loading mechanism as claimed in claim 11 wherein the extension mechanism includes an inner frame coupled across a longitudinal axis of a vehicle chassis and an outer frame telescopingly received within the inner frame, the outer frame coupled to the guide frame and moveable between the extended and retracted positions.

13. A loading device as claimed in claim 1 further including an engagement mechanism carried by the carriage for engaging a refuse container.

14. A loading mechanism as claimed in claim 13 wherein the engagement mechanism includes a gripping member carried by the carriage.

15. A loading member as claimed in claim 13 wherein the engagement mechanism includes a pair of horizontal pins vertically spaced apart rigidly coupled to opposing ends of the carriage.

16. A loading mechanism as claimed in claim 15 wherein the engagement mechanism further includes a lock mechanism for securing a refuse container thereto.

17. A loading mechanism as claimed in claim 16 wherein the lock mechanism includes a lock member pivotally coupled to the carriage and movable between a retracted position and a position overlying one of the pair of pins.

18. A loading device comprising:

a guide frame including:

a first upright member having an upper end and a lower end and a slot formed therethrough; and a second upright member having an upper end and a lower end and a slot formed therethrough, the second upright member coupled in spaced apart parallel relation to the first upright member with the slot of the first upright member substantially aligned with the slot of the second upright member;

a drive mechanism coupled to the guide frame including:

a shaft received concurrently through the slot of the first upright member and the slot of the second upright member;

a sprocket mounted on the shaft;

a belt member wrapped about the sprocket and having opposing ends anchored to the guide frame;

a first yoke block slidably carried within the slot of the first upright member and a second yoke block slidably carried within the slot of the second upright member, the shaft journaled concurrently therethrough; and a motor coupled to the shaft for reciprocating the shaft vertically within the slots between an upper position and a lower position, movement of the shaft toward the upper position producing rotation of the shaft in a first direction and a movement of the shaft toward the lower position rotating the shaft in an opposing direction;

a lift mechanism coupled to the drive mechanism and including:

a first arm having a first end coupled to the shaft and a second end;

a second arm having a first end coupled to the shaft; and a second end; and a carriage coupled to the second ends of the first arm and the second arm;

an extension mechanism for coupling the guide frame to a vehicle and moving the guide frame between an extended and a retracted position; and an engagement mechanism carried by the carriage for engaging a refuse container.

19. A loading device as claimed in claim 18 wherein the belt member includes a first belt portion and a second belt portion, the first belt portion having a first end coupled to an outer periphery of the sprocket and a second end coupled to an upper portion of the guide frame, the second belt portion have a first end coupled to an outer periphery of the sprocket and a second end coupled to a lower portion of the guide frame.

20. A loading mechanism as claimed in claim 18 wherein the guide frame further includes:

a first track formed in the first upright member and extending substantially from the lower end to terminate in a curved portion proximate the upper end for retaining and guiding the carriage; and a second track formed in the second upright member and extending substantially from the lower end to terminate in a curved portion proximate the upper end for retaining and guiding the carriage.

21. A loading mechanism as claimed in claim 20 wherein the carriage further includes cam follower carried on opposing ends thereof and receivable within and movable along the first track and the second track.

22. A loading member as claimed in claim 21 wherein the engagement mechanism includes a pair of horizontal pins vertically spaced apart rigidly coupled to opposing ends of the carriage.

23. A loading mechanism as claimed in claim 22 wherein the engagement mechanism further includes a lock mechanism for securing a refuse container thereto.

24. A loading mechanism as claimed in claim 23 wherein the lock mechanism includes a lock member pivotally coupled to the carriage and movable between a retracted position and a position overlying one of the pair of pins, and an actuating extension extending from the lock member and terminating in a cam follower, the cam follower riding within one of the tracks of the first upright member and the second upright member following the cam followers of the carriage.

25. A loading mechanism as claimed in claim 18 wherein the motor includes a hydraulic cylinder mounted to the guide frame and having a rod terminating in a bearing coupling coupled to the shaft and permitting rotation thereof, extension of the hydraulic cylinder moving the shaft to the upper position and retraction of the hydraulic cylinder moving the shaft to the lower position.

26. A loading mechanism as claimed in claim 18 wherein the motor includes a hydraulic cylinder mounted to the guide frame and having a rod coupled to the first yoke block and the second yoke block, extension of the hydraulic cylinder moving the shaft to the upper position and retraction of the hydraulic cylinder moving the shaft to the lower position.

27. A loading mechanism as claimed in claim 18 wherein the extension mechanism includes an inner frame coupled to a lower surface of a vehicle chassis and an outer frame telescopingly received within the inner frame, the outer frame coupled to the guide frame and moveable between the extended and retracted positions.

28. A loading mechanism as claimed in claim 18 wherein the drive mechanism further includes:

a second sprocket mounted on the shaft spaced from the sprocket;

a second belt member wrapped about the second sprocket and having opposing ends anchored to the guide frame; and a second motor coupled to the shaft for reciprocating the shaft vertically within the slots between an upper position and a lower position in concert with the motor.

29. A refuse collection vehicle comprising:

a chassis;

a cab at one end of the chassis;

a refuse collection body at an opposing end of the chassis;

a hopper/compactor carried between the cab and the body for receipt of refuse; and a loading device coupled to the side of the vehicle and comprising:

a guide frame including:

a first upright member having an upper end and a lower end;

a second upright member having an upper end and a lower end, the second upright member coupled in spaced apart parallel relation to the first upright member; and a drive mechanism guide defined by the first upright member and the second upright member;

an extension mechanism coupled to the chassis of the vehicle and coupled to the lower ends of the first and second upright members, the extension mechanism moving the guide frame between an extended position away from the vehicle and a retracted position towards the vehicle;

a drive mechanism coupled to the guide frame including:

a shaft received by drive mechanism guide;

a sprocket mounted on the shaft;

a belt member wrapped about the sprocket and having opposing ends anchored to the guide frame; and a motor coupled to the shaft for reciprocating the shaft vertically between an upper position and a lower position, movement of the shaft toward the upper position producing rotation of the shaft in a first direction and a movement of the shaft toward the lower position rotating the shaft in an opposing direction; and a lift mechanism coupled to the drive mechanism and including:

a first arm having a first end coupled to the shaft and a second end;

a second arm having a first end coupled to the shaft; and a second end; and a carriage coupled to the second ends of the first arm and the second arm.

30. A refuse collection vehicle as claimed in claim 29 wherein the extension mechanism includes an inner frame coupled perpendicularly to the chassis and an outer frame telescopingly received within the inner frame, the outer frame coupled to the guide frame and moveable between the extended and retracted positions.

31. A refuse collection vehicle as claimed in claim 29 wherein the belt member includes a first belt portion and a second belt portion, the first belt portion having a first end coupled to an outer periphery of the sprocket and a second end coupled to an upper portion of the guide frame, the second belt portion have a first end coupled to an outer periphery of the sprocket and a second end coupled to a lower portion of the guide frame.

32. A loading mechanism as claimed in claim 29 wherein the drive mechanism further includes a first yoke block slidably carried by the drive mechanism guide, and a second yoke block slidably carried by the drive mechanism guide, the shaft journaled concurrently therethrough.

33. A loading mechanism as claimed in claim 32 wherein the drive mechanism guide includes:

a first slot formed through the first upright member and slidably carrying the first yoke block; and a second slot formed through the second upright member and slidably carrying the second yoke block, the first slot substantially aligned with the second slot.

34. A refuse collection vehicle as claimed in claim 33 wherein the motor includes a hydraulic cylinder mounted to the guide frame and having a rod terminating in a bearing coupling coupled to the shaft and permitting rotation thereof, extension of the hydraulic cylinder moving the shaft to the upper position and retraction of the hydraulic cylinder moving the shaft to the lower position.

35. A refuse collection vehicle as claimed in claim 33 wherein the motor includes a hydraulic cylinder mounted to the guide frame and having a rod coupled to the first yoke block and the second yoke block, extension of the hydraulic cylinder moving the shaft to the upper position and retraction of the hydraulic cylinder moving the shaft to the lower position.

36. A refuse collection vehicle as claimed in claim 29 wherein the drive mechanism further includes:

a second sprocket mounted on the shaft spaced from the sprocket;

a second belt member wrapped about the second sprocket and having opposing ends anchored to the guide frame; and a second motor coupled to the shaft for reciprocating the shaft vertically within the slots between an upper position and a lower position in concert with the motor.

37. A refuse collection vehicle as claimed in claim 29 wherein the guide frame further includes:

a first track formed in the first upright member and extending substantially from the lower end to terminate in a curved portion proximate the upper end for retaining and guiding the carriage; and a second track formed in the second upright member and extending substantially from the lower end to terminate in a curved portion proximate the upper end for retaining and guiding the carriage.

38. A refuse collection vehicle as claimed in claim 37 wherein the carriage further includes cam follower carried on opposing ends thereof and receivable within and movable along the first track and the second track.

39. A loading device comprising:

a guide frame including:

a first member having a first end and a second end;

a second member having a first end and a second end, the second member coupled in spaced apart parallel relation to the first member; and a drive mechanism guide defined by the first member and the second member;

a drive mechanism coupled to the guide frame including:

a shaft received by drive mechanism guide;

a sprocket mounted on the shaft;

a belt member wrapped about the sprocket and having opposing ends anchored to the guide frame; and a motor coupled to the shaft for reciprocating the shaft between a first position toward the first ends of the members and a second position toward the second ends of the members, movement of the shaft toward the first position producing rotation of the shaft in a first direction and a movement of the shaft toward the second position rotating the shaft in an opposing direction; and an arm having a first end coupled to the shaft and a second end.

40. A loading mechanism as claimed in claim 39 wherein the drive mechanism further includes a first yoke block slidably carried by the drive mechanism guide, and a second yoke block slidably carried by the drive mechanism guide, the shaft journaled concurrently therethrough.

41. A loading mechanism as claimed in claim 40 wherein the drive mechanism guide includes:

a first slot formed through the first member and slidably carrying the first yoke block; and a second slot formed through the second member and slidably carrying the second yoke block, the first slot substantially aligned with the second slot.

42. A loading mechanism as claimed in claim 40 wherein the motor includes a hydraulic cylinder mounted to the guide frame and having a rod terminating in a bearing coupling coupled to the shaft and permitting rotation thereof, extension of the hydraulic cylinder moving the shaft to the first position and retraction of the hydraulic cylinder moving the shaft to the second position.

43. A loading mechanism as claimed in claim 40 wherein the motor includes a hydraulic cylinder mounted to the guide frame and having a shaft coupled to the first yoke block and the second yoke block, extension of the hydraulic cylinder moving the shaft to the first position and retraction of the hydraulic cylinder moving the shaft to the second position.

44. A loading mechanism as claimed in claim 39 wherein the drive mechanism further includes:

a second sprocket mounted on the shaft spaced from the sprocket;

a second belt member wrapped about the second sprocket and having opposing ends anchored to the guide frame; and a second motor coupled to the shaft for reciprocating the shaft between the first position and the second position in concert with the motor.

* * * * *

UNITED STATES PATENT AND TRADEMARK OFFICE

CERTIFICATE OF CORRECTION

PATENT NO. : 6,491,489 B1
DATED : December 10, 2002
INVENTOR(S) : Stragier, Marcel G.

It is certified that error appears in the above-identified patent and that said Letters Patent is hereby corrected as shown below:

Title page,
Item [73], Assignee, change name from "The Hell Co." to -- The Heil Co. --.

Signed and Sealed this

Twenty-second Day of June, 2004

JON W. DUDAS
*Acting Director of the United States Patent and Trademark Office*